US007243455B2

(12) United States Patent
Jurk

(10) Patent No.: US 7,243,455 B2
(45) Date of Patent: Jul. 17, 2007

(54) MULTI-PURPOSE AIMING AID AND METHOD FOR USING SAME

(76) Inventor: Allan G. Jurk, 1979 County Road 219, Giddings, TX (US) 78942

( * ) Notice: Subject to any disclaimer, the term of this patent is extended or adjusted under 35 U.S.C. 154(b) by 0 days.

(21) Appl. No.: 11/236,232

(22) Filed: Sep. 27, 2005

(65) Prior Publication Data

US 2007/0068056 A1 Mar. 29, 2007

(51) Int. Cl.
*F41C 27/00* (2006.01)

(52) U.S. Cl. ..... 42/94

(58) Field of Classification Search ..... 42/94; 248/102, 105, 229.2, 229.26
See application file for complete search history.

(56) References Cited

U.S. PATENT DOCUMENTS 5,930,931 A * 8/1999 Watson ..... 42/94

* cited by examiner

*Primary Examiner*—Michael J. Carone
*Assistant Examiner*—Gabriel J. Klein

(57) ABSTRACT

The present invention provides stable support for the extended arm of the operator of a projectile weapon or camera. The invention contains two support members oriented opposed from one another and connected by telescoping support extension members. One support member accepts the user's arm, while the other accepts the user's thigh. Since the invention supports the user's arm rather than the object being used, the invention may accommodate—without alteration—any device the user wishes to operate. Between each support member and the extension member is a connector which provides for 360 degree rotation of each support member. This innovation allows the user to extend or contract the user's arm while still supported by the invention, thereby alleviating the fatigue which may develop from keeping the arm fixed in an extended position. The invention requires no straps or other means to affix it to the operator's body and instead is held in place by tension between the user's arm and the user's thigh. This design helps minimize injury from a fall by enabling the user to quickly discard the invention. The noiseless operation of the invention ensures it will not frighten away game or other wildlife.

20 Claims, 5 Drawing Sheets

MULTI-PURPOSE AIMING AID AND METHOD FOR USING SAME

BACKGROUND OF THE INVENTION

1. Field of the Invention

Applicants' invention relates generally to an aiming and shooting support apparatus, designed to assist disabled users of devices needing to be aimed, such as projectile weapons or video recording devices, but with application for all users of such devices. More specifically, it relates to a lightweight, portable, aiming and shooting device that provides hunters, photographers, and others with an easily guidable, stable, fatigue-reducing support apparatus.

2. Background Information

It is well known that holding a weight at arm's length for an extended period is fatiguing. When a person is attempting to aim a weapon, a telephoto camera, or other device requiring high degrees of stability, such fatigue can cause aim-spoiling muscle spasms or trembling. Also, persons with a disability in one arm, such as loss of use of levitator muscles in the shoulder, are unable to properly hold and aim two-handed weapons such as rifles and bows.

Accordingly, inventors have devised a number of braces that assist the user in supporting their arm as discussed below; however, these devices have a number of flaws making them inferior to the present invention.

U.S. Pat. No. 2,474,050 issued to Herbert H. Harris on Jun. 21, 1949 discloses an armrest, which must be attached to the user's arm via an encircling strap and buckle arrangement. The arm-encircling strap and bracket are attached to a brace via a hinge, but the device does not rotate about its axis. The bottom of the brace is a friction pad designed to rest against the body or a flat work surface; however, it does not provide sufficient stability for firing a rifle or shotgun.

U.S. Pat. No. 4,575,964 issued to Donnie R. Griffin on Mar. 18, 1986 discloses a portable gun rest. The rest has two U-shaped saddle members, one of which fits over the thigh with the other fitting under the weapon. The two saddle members are held in coaxial alignment by the same pin that adjusts the height of the rest. Only when the pin is removed and the rest retracted to its shortest height can the saddle members freely rotate about the longitudinal axis of the brace. The upper end of the device is designed to directly hold a rifle or shotgun.

U.S. Pat. No. 5,351,867 issued to Clyde L. Vest on Oct. 4, 1994 discloses an arm steady brace (The "Vest brace"). The brace is strapped or clipped to the user's belt and then extends upward to support the user's forearm. When not supporting the user's arm, it is carried in a locked downward position, which can hinder mobility and elevates the risk of an impalement injury in the event of a fall.

U.S. Pat. No. 5,930,931 issued to Jerry Wade Watson on Sep. 15, 1997 discloses an adjustable gun rest. Like the Griffin device, this device directly supports the weapon; however, this device improves upon the Griffin device by allowing the user to position the weapon at an angle other than parallel with the user's thigh. A set-screw allows variable adjustment of the gun rest's height, as opposed to the discrete adjustment settings of the Griffin device.

U.S. Pat. No. 5,685,104 issued to Robert P. Breazeale, Jr. on Nov. 11, 1997 discloses a gun rest that mounts to a tree stand. The device directly supports the weapon, but is unusable except in a tree stand.

U.S. Pat. No. 6,637,708 B1 issued to Thomas K. M. Peterson on Oct. 23, 2003 discloses an articulated aiming support. This support directly supports the weapon and is mounted to a shooting platform or tree stand. Like the Breazeale device, the support is unusable away from a platform or stand.

Thus, there is a need for a method and device for supporting the support arm of the user, both in a resting position and in a shooting position. Further, it is advantageous for the device to provide sufficient stability for firing a weapon, be freely rotatable about the longitudinal axis of the device in any configuration, is not attached to the user, and is not attached to an inanimate object.

The present invention addresses the requirement for a lightweight, portable aiming device that provides a wide range of motion without manual adjustment, reduces fatigue, and adapts to a range of shooting positions.

SUMMARY OF THE INVENTION

By the present invention, a unique aiming aid is disclosed.

Accordingly, one of the objects of the present invention is to provide an improved arm brace that will enable a person unable to lift the user's arm to effectively hold and aim a weapon or other device.

Another of the objects of the invention is to provide an improved arm rest that is easier and less expensive to manufacture than those available in the past.

Another of the objects of the invention is to provide an improved arm rest that is comfortable for extended use and reduces the fatigue of holding a weapon or other device in a ready position.

Another of the objects of the invention is to provide an improved arm rest providing freedom of movement and aim, while maintaining a stable firing platform and without requiring the user to remove the user's hands from the weapon to make adjustments.

Another of the objects of the invention is to provide an improved arm rest that reduces the risk of injury during a fall by not being attached to the user and thus more easily rid of by the user in the event of a fall or other accident. Because it is not attached, if the user falls, the natural movement of the user's arms and legs will tend to allow the invention to fall away from the user and thus reduce the risk of injury due to the user falling on an end of the device.

Still another object of the invention is to provide an improved arm rest that is lightweight, easily portable, usable from the sitting or kneeling positions, and silent in use.

The most obvious difference between the present invention and the prior art, other than the Vest brace, is that the present invention, rather than directly supporting a rifleman's weapon, supports the rifleman's extended support arm. This fundamental difference provides several main benefits. First, by allowing the user to hold the weapon with the user's hand rather than separating the two by placing the weapon on an inanimate object, the user has a better "feel" of the weapon and thus obtains more control over its acute manipulation providing for more accurate aim than with a device that attaches to the weapon and separates the weapon from the user. Second, the device enables a wide range of motion without requiring the user to remove the user's hands from the weapon to make an adjustment. Third, users of the aiming aid are not limited to the use of weapons or cameras that fit in, or are attachable to, the aiming aid itself. Virtually anything that is intended to be held and aimed by hand is usable, including without limitation, firearms, bows and cameras. Fourth, the aiming aid is ideal for use by any individual who has limited strength in their support arm, such as the elderly, youths, and handicapped individuals who cannot raise their support arm but can still flex their elbow and maintain a grip on a weapon, providing the user with a natural aiming and shooting experience, without the requirement for rigidly-mounted braces or safety-endangering straps and clips.

The present invention differs from the Vest brace by providing an arm-bracing system that is more comfortable for prolonged periods of arm extension and more stable than a hip-mounted, belt-clip base.

DETAILED DESCRIPTION OF THE PREFERRED EMBODIMENT

Figure 1:
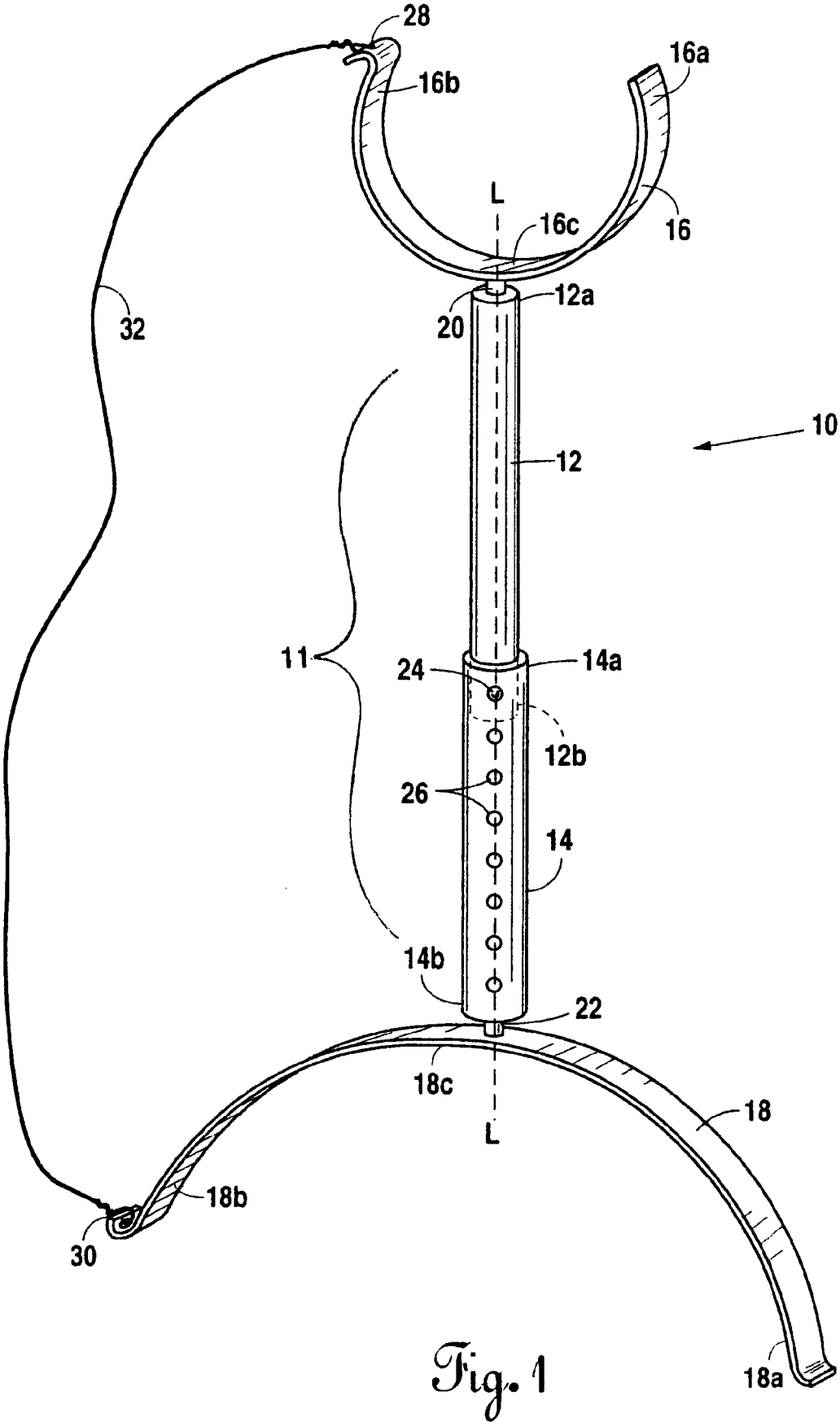
FIG. 1 is a perspective view of the present invention in an extended position.

Referring to the figures, FIG. 1 shows a perspective view of the aiming aid (10) in an extended position. The aiming aid (10) is comprised of a leg support member (18) and an arm support member (16) with a support shaft (11) having a axis (L—L) disposed between them. The support shaft first end (11*a*) attached to the arm support member (16) and the support shaft second end (11*b*) attached to the leg support member (18). The length of the support shaft (11) is adjustable. The support shaft (11) is comprised of a first extension member (12) and a second extension member (14). The leg support member (18) is attached via a second connector (22) to the second extension member (14). The first extension member (12) fits inside of and is coaxial with the outer brace tube. The first extension member (12) is connected to the arm support member (16) via a first connector (20).

The overall length of the support shaft (11) and consequently the aiming aid (10) is adjustable due to the first extension member (12) being slidably engageable with the second extension member (14) so as to change the length of said support shaft (11). Generally, it is anticipated that first extension member (12) and the second extension member (14) will be hollow or tubular shaped, and that the first extension member (12) will be shaped and sized so as to fit within the second extension member (14) (or vice versa). The length of the support shaft (11) is adjusted by means of the first extension member's (12) telescoping into, or outwardly from, the second extension member (14) (or vice versa). In the preferred embodiment, a set pin (24) fits into one of a plurality of apertures (26) in the second extension member (14) and thus can be used to adjust and fix the length of the support shaft (11). However, it is anticipated that other set means of altering and fixing the length of the aiming aid (10) may be used, including but not limited to: pneumatics, hydraulics, friction devices, threaded devices, removable locking pins, clamps, or other devices familiar to those with ordinary skill in the art. The adjustable nature of the first extension member (12) and the second extension member (14) allows for use of the aiming aid (10) by operators of different physical proportion and also provides the user with the ability change, during the course of aiming and shooting, the user's support arm and weapon positioning with minimized limitations.

Opposite ends of an optional sling (32) are attached to, and the sling (32) runs between, an arm support connection piece (28) and a leg support connection piece (30). The sling (32) allows for hands-free carrying of the aiming aid (10). The arm support connection piece (28) is attached to the arm support member second end (16*b*) and the leg support connection piece (30) is attached to the leg support member second end (18*b*). The support connection pieces (28 & 30) may be designed to break away from the ends of the sling (32), or from the arm support member (16) and the leg support member (18), when placed under stress, prior to the remainder of the aiming aid (10). This "break away" design helps to reduce the likelihood of injury to the user in the event of the aiming aid (10) hanging on a snag or other accident. It is anticipated that the support connection pieces (28 & 30) could include buttons, snaps, clips, or other devices designed for closure but allowing release as are familiar to those with ordinary skill in the art. Alternatively, the sling (32) can be designed with a limited tensile strength, or limited tensile strength at desired "break points," to provide the same sort of safety mechanism. The arm support member (16) and the leg support member (18) curl outward at the carrying-strap support connection pieces (28 & 30), preventing the aiming aid (10) from snagging on the operator's clothing or body, and ensuring smooth movement during operation.

In the preferred embodiment of the aiming aid (10), the arm support member (16) and the leg support member (18) are arcuate in order to engage the user's arm and leg respectively. It is further intended that the arm support member (16) and the leg support member (18) be able to adaptively fit a variety of users' body dimensions. For this reason; the arm support member (16) and the leg support member (18) are sized and shaped to fit a relatively large number of various sized users' arms and legs. Additionally, the arm support member (16) and the leg support member (18) may be constructed of a material that is pliable enough so as to allow the user to repetitively shape and reshape the arm support member (16) and/or the leg support member (18) in order to provide a custom fit for different users (or for the same user if a different fit becomes desirable), but that does not deform during normal use or transport.

It is anticipated that the arm support member (16) and the leg support member (18) will be constructed so as to provide an appropriate trade-off between weight distribution (which favors a wider surface area) and maneuverability (which favors a narrower surface area). To best accomplish this goal, it is anticipated that arm brace contact surface (16*c*) and the thigh brace contact surface (18*c*) will be in the range between 0.5 inches and 2.5 inches wide. Other widths are contemplated for different uses of the aiming aid (10), depending upon the maneuverability required by the application and the weight that the user's arm must support in such application.

In the preferred embodiment, the arm support member (16) is shaped in a symmetrical or asymmetrical "u-shape." Often, the lateral or outside half of the arm support member (16), running from the point at which the first connector (20) is connected to the arm support member (16) to the arm support member second end (16*b*), has a gradual convex curve to accommodate the shape of the user's outer arm and arm muscle typically existing on the outside of the arm. The medial or inside half of the arm support member (16), running from the point at which the first connector (20) is connected to the arm support member (16) to the arm support member first end (16*a*), generally has a more acute and immediate curve, designed to fit the flatter, inside part of the user's arm. Additionally, the arm support member (16) of the aiming aid (10) fits to the user's arm, rather than to the specific weapon or device being supported, thus giving the aiming aid (10) universal application. The user therefore may employ the aiming aid (10) to support a camera, rifle, pistol, bow, nail guns, drills, or any other device or weapon supported by one arm. Even if only the user's arm is to be supported in order to help the user employ the supported hand, the aiming aid (10) can be effective.

In an alternative embodiment, the medial portion or side of the leg support member (18) may be longer than the lateral portion or side. The medial portion of the leg support member (18), running from the point at which the second connector (22) is connected to the leg support member (18) to the leg support member first end (16*a*), rests over the medial aspect of the thigh, while the lateral portion of the leg support member (18), running from the point at which the second connector (22) is connected to the leg support member (18) to the leg support member second end (16*b*), rests over the lateral aspect of the thigh. The arcuate shape of the leg support member (18) allows for comfortable rotation of the leg support member (18) about the thigh while maintaining overall stability of the braced arm. Thus, the extra length of the leg support member (18) on the medial aspect of the thigh maintains stability of the aiming aid (10) as the user rotates the user's upper body away from center, such as in aiming to the side (as shown in FIGS. 4*c* and 5*c*). The rotation ability of the invention allows the user to easily rotate the user's upper body from side to side without needing to remove the user's hands from the weapon, camera or other device.

The aiming aid (10) may be made using a variety of materials, such as metals, alloys, carbon fibers, plastics, ceramics, fiberglass, and a variety of coatings, such as paint, Teflon or non-stick coatings, fabric, sealed foam or other padding, gels, powder coating, bluing, or anodization. Other materials and coatings that conform to the manufacturing and use requirements of the aiming aid (10) are also contemplated by the invention. The advantages of the various materials and coatings is apparent when contemplated with respect to the use of the aiming aid (10). For example, stainless steel used in the manufacture of the aiming aid (10) would provide great strength as well as not rusting in the field. Aluminum and carbon fiber would provide strength and would not rust, but would also be generally lighter weight. Coatings, such as non-stick and padding on the arm support member contact surface (16*c*) and leg support member contact surface (18*c*) would provide increased ease of maneuverability and comfort for the user.

Figure 2:
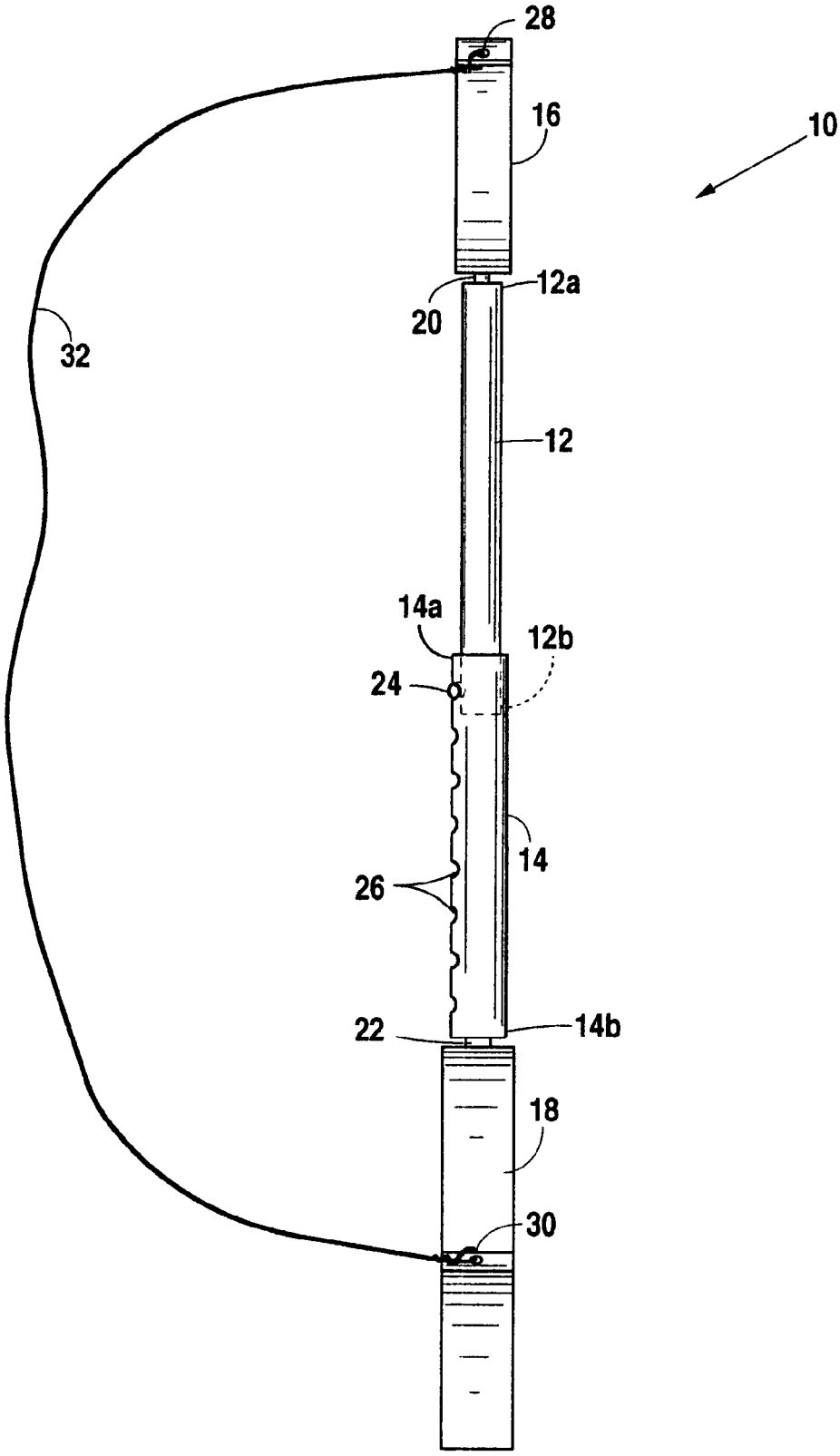
FIG. 2 is a side view of the present invention.

FIG. 2 shows a side view of the aiming aid (10). As shown from this angle, the aiming aid (10) incorporates a first extension member (12) and a second extension member (14) which telescope within each other along an axis (L—L) (as shown in FIG. 1) and such that the aiming aids (10) overall length is adjustable. As shown in this embodiment of the aiming aid (10), the orientation of the first extension member (12) to the second extension member (14) is set via a spring loaded set pin (24) which, when oriented with one of the apertures (26), springs outwardly to affix the position of the first extension member (12) relative to the second extension member (14). In order to affect the telescoping action of the extension members (12) and (14), the outer diameter of the first extension member (12) is sized slightly less than the inner diameter of the second extension member (14). In this embodiment, the first extension member second end (12*b*) slides into the interior of the second extension member (14) through the second extension member second end (14*b*). At the first extension member first end (12*a*), the arm support member (16) is connected via a first connector (20). The first connector (20) is rotatable about the axis (L—L) likewise allowing the arm support member (16) to rotate about the axis (L—L).

At the second extension member second end (14*b*) the leg support member (18) is connected via a second connector (22) which is rotatable about the axis (L—L). Like the arm support member (16), the leg support member (18) is rotatable about the axis (L—L). A sling (32) is connected at each end, one to the arm support connection piece (28) which may be found near the arm support member second end (16*b*), and to the leg support connection piece (30) which is found at or near the leg support member second end (18*b*). The sling (32) may be used by the user to strap the aiming aid (10) to the user's body while the aiming aid (10) is not use and the user is changing position.

Figure 3:
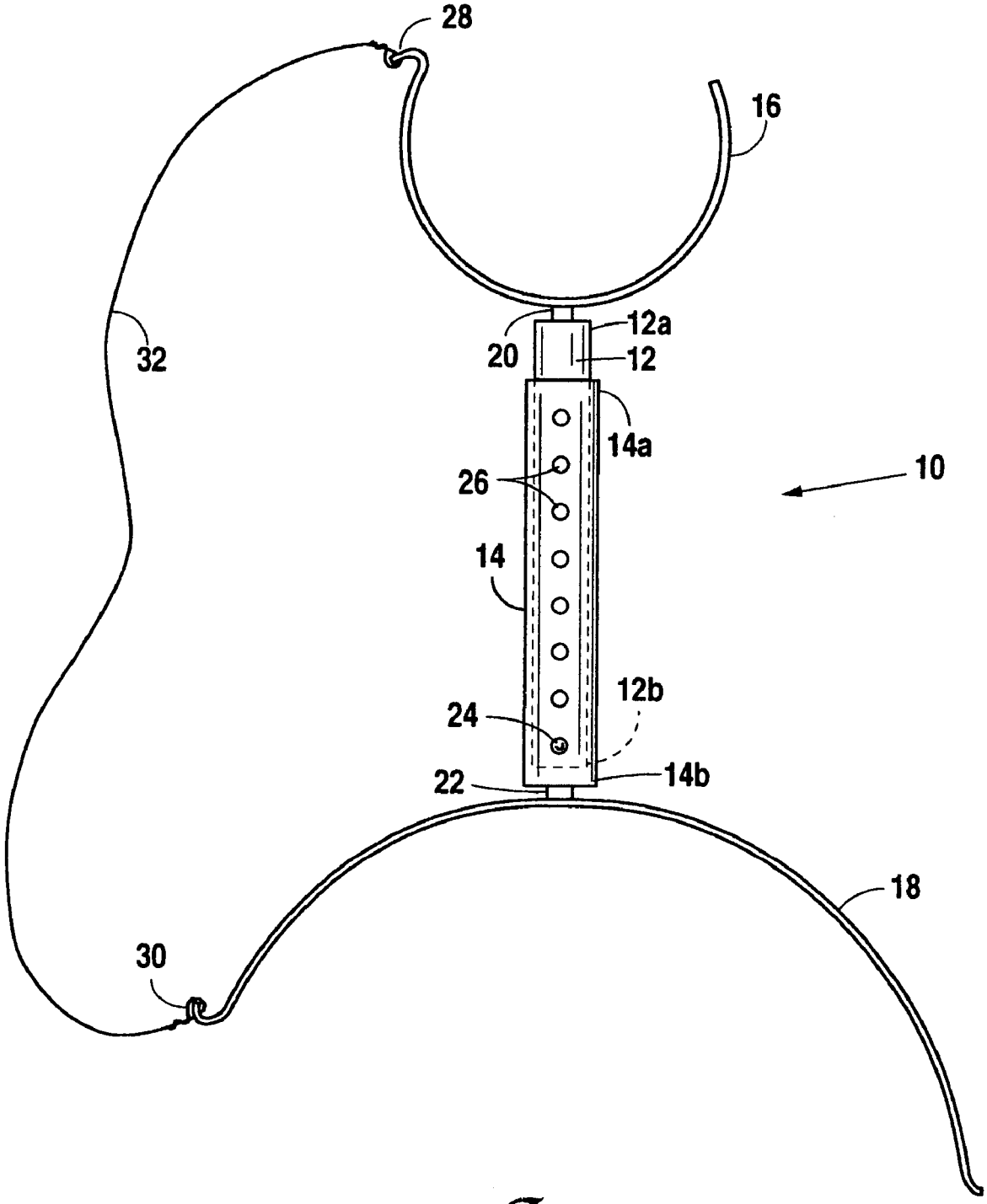
FIG. 3 is a front view of the present invention in a retracted position.

FIG. 3 shows a front perspective view of the aiming aid (10) in a retracted position. In contrast, FIG. 1 showed the same view of the aiming aid (10), but in an extended position. A comparison of FIGS. 1 and 3 illustrates how the aiming aid (10) can be adjusted to fit both different sized users and various aiming positions. As shown in FIG. 3, a more retracted position of the first extension member (12) and the second extension member (14), would be appropriate for a smaller user. Similarly, it would also be appropriate for those situations in which the user was aiming downward such as from a tree stand or high position. In contrast, the extended position as shown in FIG. 1 would be more useful for a taller user or for a user who is aiming upwards such as when shooting fowl. Or, a central position might be most appropriate for aiming along a generally horizontal plane. As will be noted, it is anticipated that there will be multiple positions that allow for a range of combined length of the first extension member (12) and the second extension member (14). Thus, it is anticipated that the illustrated set pin (24) and aperture (26) means for setting the overall length of the first extension member (12) and second extension member (14) is only one of a number of means of doing so. Other anticipated means include, but are not limited to, rotational means using pressure on the first extension member (12) and/or second extension member (14), hydraulic means, set screw means, springed means, set pin means, as well as other like means. FIG. 3 also illustrates that while the relative length of the first extension member (12) and second extension member (14) can be modified, the remaining components of the aiming aid (10) do not change. The arm support member (16) still accepts the user's arm and is rotatable about the (L—L) axis of the aiming aid (10) by means of the first connector (20). Like wise, the leg support member (18) still engages the user's leg and is also rotatable about the axis (L—L) of the aiming aid (10) by means of the second connector (22). While it is anticipated that most embodiments of the aiming aid (10) will incorporate tubular first extension members (12) and second extension members (14), there is no intended limitation regarding the shape of the first extension member (12) and second extension member (14). For example, the extension members (12) and (14) could be rectangular or triangular in shape so long as the prospective shapes of the first extension member (12) and second extension member (14) allowed for adjustment of the overall length of the aiming aid (10). Likewise, it is irrelevant whether the first extension member (12) fits within the second extension member (14), or the second extension member (14) fits within the first extension member (12), again so long as the overall embodiment of the aiming aid (10) allows for modification of the overall length.

Figure 4A:
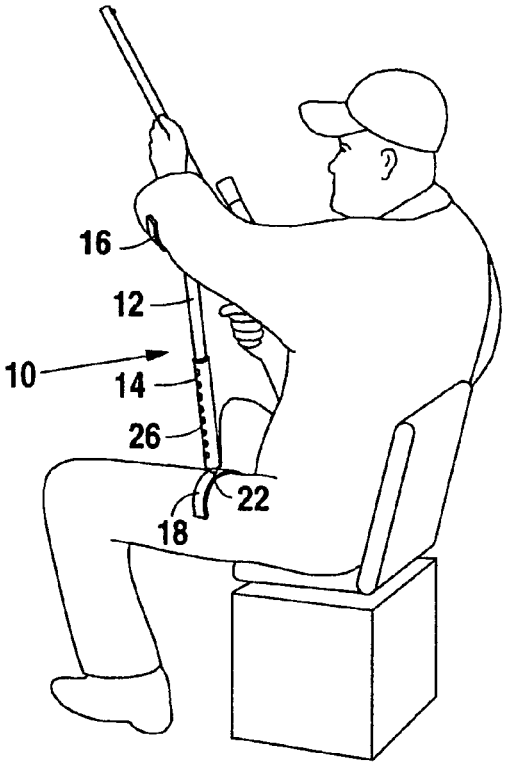
FIG. 4*a* shows the present invention in use in an extended position at rest.

FIG. 4*a* illustrates the use of the aiming aid (10) with a rifle as shown in a resting position. The user, in a kneeling or sitting position, places the leg support member (18) atop the user's thigh, close to the crotch, with the long part of the brace on the inner thigh. The user then places the arm support member (16) either superior or inferior to the user's elbow depending upon the desired trajectory of the shot. The first extension member (12) and the second extension member (14) can be adjusted to provide the desired support height. The user holds the device in place by maintaining slight pressure between the user's arm and the user's thigh. Rotation of first connector (20) and second connector (22) allow the user to flex the user's elbow while maintaining the invention and weapon in a ready position, greatly decreasing or eliminating the fatigue caused by other devices that tend to lock the arm in an extended position.

Figure 4B:
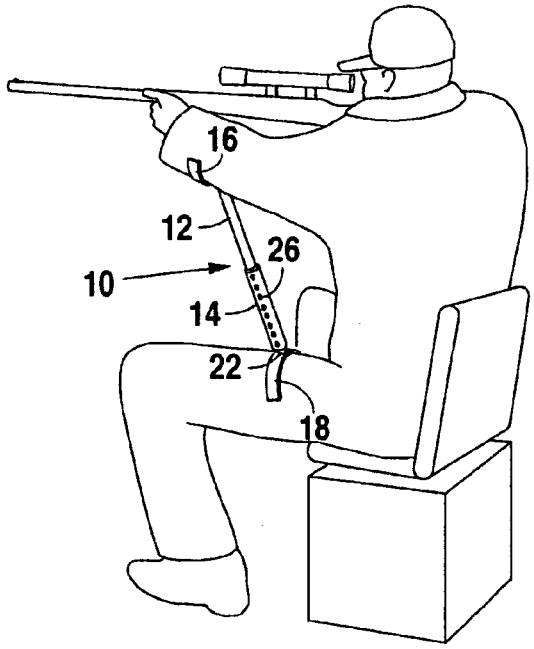
FIG. 4*b* shows the present invention in use in an extended position aiming forward.
Figure 4C:
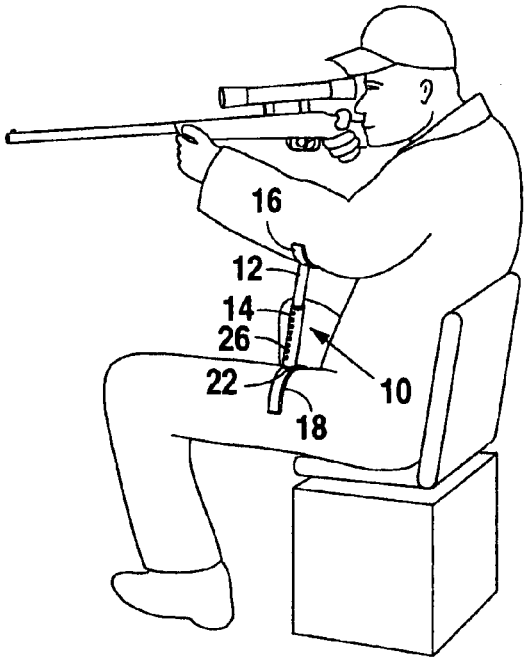
FIG. 4*c* shows the present invention in use in an extended position aiming to the side.

FIGS. 4*b* and 4*c* illustrate the use of the aiming aid (10) with a rifle as shown aiming forward and rotated aiming to the side. The first connector (20) and second connector (22) allow the arm support member (16) and the leg support member (18) to rotate a full 360 degrees about the common axis (L—L) (as shown in FIG. 1) of the first extension member (12) and the second extension member (14). This rotation provides the user with a wide range of motion without sacrificing stability. Further, this free rotation allows the aiming aid (10) to be used on either side of the body, regardless of which thigh is used as a support point. No straps or other means are required to secure the aiming aid (10) to the user's body during use. Not being secured to the user's body is an advantage of the aiming aid (10) because it may be more rapidly deployed in preparation for a quick shot. Additionally, the lack of straps or other securing means attaching the aiming aid (10) to the user, allow the aiming aid (10) to be quickly and easily discarded in the event of a fall by the user, thereby reducing the risk of injury due to contact with the aiming aid (10). The absence of straps securing the aiming aid (10) to the user's body also facilitates the smooth movement and guidance of the camera or weapon as the operator rotates the user's torso, allowing the hunter or photographer to freely track or lead an animal.

Providing a multitude of possible positions, with a minimum of adjustment, is the most import feature of the aiming aid (10). Once the user has established a position relative to the anticipated target, for example in a tree stand looking down on a game trail, the user sets the length of the support shaft (11) and will generally not need to reset the length. After setting this length, the user can move the user's arm, leg, and torso in order to acquire the target. Thus, the degrees of freedom of movement inherent in the aiming aid (10) allow the user to swing, for example, from the position shown in FIG. 4*b* to the position shown in FIG. 4*c* as a user might do in tracking the movement of a target without changing the basic length of the support shaft (11). After such gross movement positions the aim of the user in the general vicinity of the target, the support the aiming aid (10) provides to the user helps the user make fine adjustment movements to zero in the user's aim on the target. This ability to make fine adjustments, while not having to readjust the length of the support shaft (11), during the use of the aiming aid (10) is essential for accuracy.

Figure 5A:
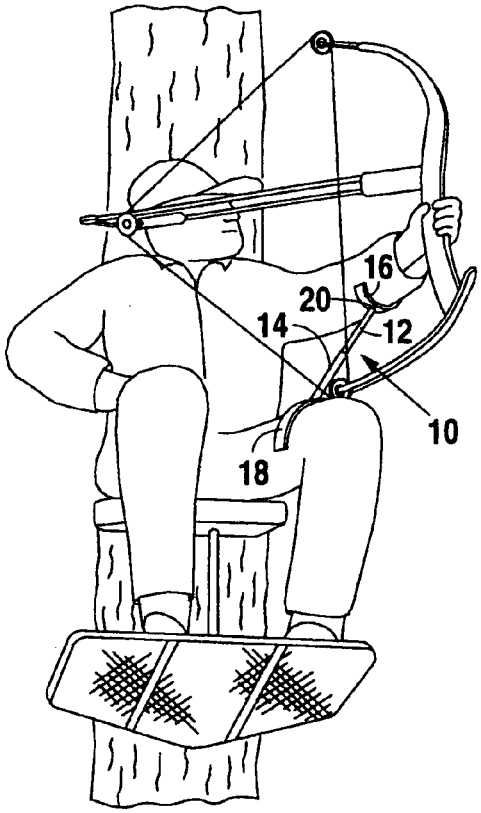
FIG. 5*a* shows the present invention in use in a retracted position at rest.
Figure 5C:
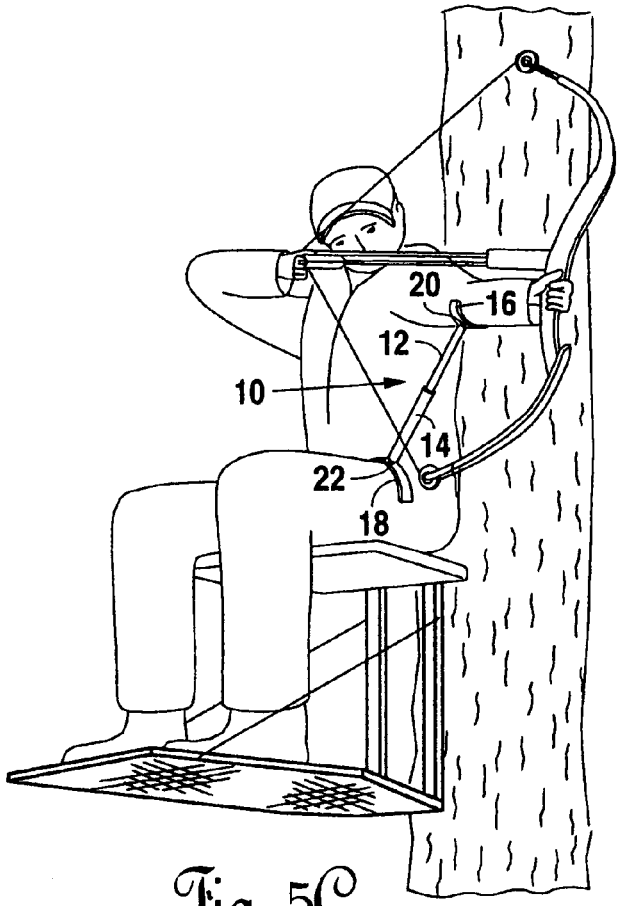
FIG. 5*c* shows the present invention in use in a retracted position aiming to the side.
Figure 5B:
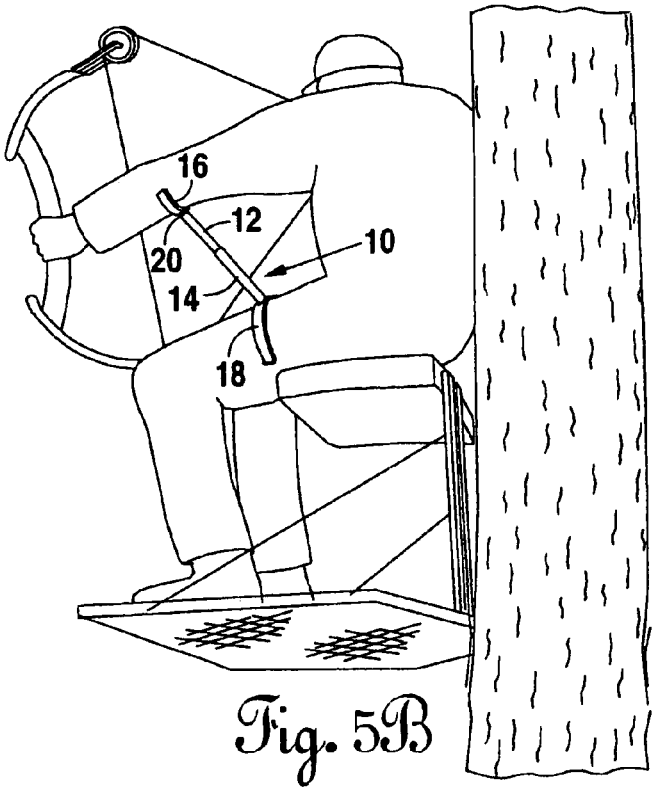
FIG. 5*b* shows the present invention in use in a retracted position aiming forward.

FIGS. 5*a*, 5*b* and 5*c* illustrate the use of the aiming aid (10) with a bow as shown in a resting position, aiming forward, and rotated aiming to the side. The portable design of the invention allows for its use in a variety of situations and positions, including, but not limited to: use in blinds, tripods, or tree stands; while the user is kneeling; or while the user is sitting in a chair or on the ground.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim

1. An aiming aid for a user for supporting a user's arm on a user's leg, comprising:

a leg support member, wherein said leg support member is arcuate and engageable with said user's leg;

a arm support member, wherein said arm support member is arcuate and engageable with said user's arm;

a support shaft disposed between said leg support and said arm support, wherein a support shaft first end is attached via a first connector to said arm support member and a support shaft second end is attached via a second connector to said leg support member, and the length of said support shaft is adjustable;

wherein said first connector and said second connector are rotatable; and wherein said leg support member can be repetitively shaped and reshaped to fit said leg of said user; and said arm support member can be repetitively shaped and reshaped to fit said arm of said user.

2. The aiming aid of claim 1 wherein said support shaft is further comprising:

a first extension member;

a second extension member; and wherein said first extension member is slidably engageable with said second extension member so as to change the length of said support shaft.

3. The aiming aid of claim 2 wherein said first extension member is tubular and said second extension member is tubular, and said first extension member slidably fits within said second extension member.

4. The aiming aid of claim 1 further comprising a set means for fixing the length of said support shaft.

5. The aiming aid of claim 1 wherein the length of said leg support member from its connection point to said second connector to a leg support member first end is longer than the length of said leg support member from its connection point to said second connector to a leg support member second end.

6. The aiming aid of claim 1 further comprising:

a leg support connection piece attached to said leg support member second end;

an arm support connection piece attached to said arm support member second end; and a sling attached to said leg support connection piece and said arm support connection piece.

7. The aiming aid of claim 6 wherein said leg support connection piece and said arm support connection piece are designed to break, when placed under stress, prior to the remainder of said aiming aid.

8. The aiming aid of claim 1 wherein said arm support member has an arm support member contact surface for contacting said user's arm and said arm support member contact surface is in the range of 0.5 inches and 2.5 inches wide; and wherein said leg support member has an leg support member contact surface for contacting said user's leg and said leg support member contact surface is in the range of 0.5 inches and 2.5 inches wide.

9. An aiming aid for a user for supporting a user's arm on a user's leg, comprising:

a leg support member, wherein said leg support member is arcuate and engageable with said user's leg;

a arm support member, wherein said arm support member is arcuate and engageable with said user's arm;

a support shaft disposed between said leg support and said arm support, wherein a support shaft first end is attached via a first connector to said arm support member and a support shaft second end is attached via a second connector to said leg support member, and the length of said support shaft is adjustable;

wherein said first connector and said second connector are rotatable; and wherein the length of said leg support member from its connection point to said second connector to a leg support member first end is longer than the length of said leg support member from its connection point to said second connector to a leg support member second end.

10. The aiming aid of claim 9 wherein said support shaft is further comprising:

a first extension member;

a second extension member; and wherein said first extension member is slidably engageable with said second extension member so as to change the length of said support shaft.

11. The aiming aid of claim 10 wherein said first extension member is tubular and said second extension member is tubular, and said first extension member slidably fits within said second extension member.

12. The aiming aid of claim 9 further comprising a set means for fixing the length of said support shaft.

13. The aiming aid of claim 9 further comprising:

a leg support connection piece attached to said leg support member second end;

an arm support connection piece attached to said arm support member second end; and a sling attached to said leg support connection piece and said arm support connection piece.

14. The aiming aid of claim 13 wherein said leg support connection piece and said arm support connection piece are designed to break, when placed under stress, prior to the remainder of said aiming aid.

15. The aiming aid of claim 9 wherein said arm support member has an arm support member contact surface for contacting said user's arm and said arm support member contact surface is in the range of 0.5 inches and 2.5 inches wide; and wherein said leg support member has an leg support member contact surface for contacting said user's leg and said leg support member contact surface is in the range of 0.5 inches and 2.5 inches wide.

16. An aiming aid for a user for supporting a user's arm on a user's leg, comprising:

a leg support member, wherein said leg support member is arcuate and engageable with said user's leg;

a arm support member, wherein said arm support member is arcuate and engageable with said user's arm;

a support shaft disposed between said leg support and said arm support, wherein a support shaft first end is attached via a first connector to said arm support member and a support shaft second end is attached via a second connector to said leg support member, and the length of said support shaft is adjustable;

a leg support connection piece attached to said leg support member second end;

an arm support connection piece attached to said arm support member second end; and a sling attached to said leg support connection piece and said arm support connection piece; and wherein said first connector and said second connector are rotatable.

17. The aiming aid of claim 16 wherein said support shaft is further comprising:

a first extension member;

a second extension member; and wherein said first extension member is slidably engageable with said second extension member so as to change the length of said support shaft.

18. The aiming aid of claim 17 wherein said first extension member is tubular and said second extension member is tubular, and said first extension member slidably fits within said second extension member.

19. The aiming aid of claim 16 further comprising a set means for fixing the length of said support shaft.

20. The aiming aid of claim 16 wherein said arm support member has an arm support member contact surface for contacting said user's arm and said arm support member contact surface is in the range of 0.5 inches and 2.5 inches wide; and wherein said leg support member has an leg support member contact surface for contacting said user's leg and said leg support member contact surface is in the range of 0.5 inches and 2.5 inches wide.

* * * * *